US005277016A

United States Patent [19]

Williams et al.

[11] Patent Number: 5,277,016

[45] Date of Patent: Jan. 11, 1994

[54] ICE CUBE MAKING, BAGGING, AND STORING APPARATUS

[75] Inventors: Howard M. Williams; Kostas P. Ioannidis, both of Houston; James W. Kisling, III, Kingwood; Bryan E. Lynch, The Woodlands, all of Tex.

[73] Assignee: Ice Systems, Inc., Houston, Tex.

[21] Appl. No.: 927,825

[22] Filed: Aug. 10, 1992

[51] Int. Cl.[5] ..... B65B 5/06; B65B 1/32; F25C 5/18

[52] U.S. Cl. ..... 53/459; 53/468; 53/502; 53/573; 62/60; 62/344

[58] Field of Search ..... 53/459, 468, 469, 467, 53/473, 502, 167, 572, 573, 571, 251, 250; 62/344, 60, 135, 340, 377

[56] References Cited

U.S. PATENT DOCUMENTS

| | | | |
|---|---|---|---|
| 3,009,336 | 11/1961 | Bayston et al. | 62/344 |
| 3,151,668 | 10/1964 | Zimmermann | 165/30 |
| 3,207,366 | 9/1965 | Feistel, Jr. | 222/2 |
| 3,654,771 | 4/1972 | Kuebler | 62/352 |
| 3,712,019 | 1/1973 | Lamka et al. | 53/25 |
| 3,727,374 | 4/1973 | Williams | 53/189 |
| 3,789,570 | 2/1974 | Mullins, Jr. | 53/29 |
| 3,807,193 | 4/1974 | McKenney et al. | 62/322 |
| 3,851,444 | 12/1974 | Merat | 53/167 |
| 3,913,343 | 10/1975 | Rowland et al. | 62/137 |
| 4,368,608 | 1/1983 | Ray | 53/440 |
| 4,428,179 | 1/1984 | Jordan et al. | 53/502 |
| 4,607,478 | 8/1986 | Maglecic | 53/502 |
| 4,689,937 | 9/1987 | Finan, Sr. et al. | 53/502 |
| 5,109,651 | 5/1992 | Stuart | 53/502 |

*Primary Examiner*—James F. Coan
*Attorney, Agent, or Firm*—Vaden, Eickenroht, Thompson, Boulware & Feather

[57] ABSTRACT

A method of and apparatus for bagging ice cubes produced by a plurality of cubers with only one bagger when the cubers are stacked side-by-side with the ice produced by each cuber falling into one of two hoppers. The ice is moved from each hopper alternately to the bagger. There each batch of ice cubes is dropped into a bag, the bag sealed, and moved to a storage bin positioned below the bagger. The bags have a short side and a long side with the long side having holes to allow the bags to be supported by horizontal parallel rods extending through the holes. A platen is moved against the short side of a plurality of bags hanging from a first set of parallel rods extending through the holes in the long side of the bags. The air pressure between the platen and the short side of the bag is reduced to cause ambient atmospheric pressure to hold the short side of the outside bag against the platen. Moving the platen laterally moves the short side of the bag away from the long side and opens the bag as the bag is positioned under an ice dispensing chute. The holes in the long side are moved over a second pair of parallel support rods at the same time. A platform supports the bottom of the bag and a sleeve supports the bag laterally as the bag is filled with ice. After the bag is sealed, it is moved laterally off the support and tilted by the sleeve so that the bag falls sideways into a storage bin.

25 Claims, 4 Drawing Sheets

ICE CUBE MAKING, BAGGING, AND STORING APPARATUS

This invention relates to automated ice-making, bagging, and storing apparatus that can be located in a store, such as a grocery store, and supply bags of ice for sale to the customers of the store.

There has always been a need for apparatus that, when supplied with water and power, can convert the water to ice cubes, place the ice in a bag, seal the bag, and deliver the bag to a storage bin where customers can remove the bags when purchased. The great advantage of this arrangement is that it gives the store manager control over his supply of ice. He is no longer dependent on an ice company that is delivering bagged ice to a large number of customers. With the apparatus of this invention, he can make more ice than he sells during the slow days to get ready for the heavy demand days, such as the week-end.

The automatic ice bagger described in U.S. Pat. No. 4,368,608, which issued to Jimmy C. Ray on Jan. 18, 1983, was designed to do this and apparently does to some extent, but the machine has some design problems and requires lots of maintenance.

In addition, Ray's apparatus is generally limited to one ice cube making machine, hereinafter called a "cuber", per bagger because the ice produced by Ray's cuber falls directly into his bagger. Therefore, if an additional cuber is required at a given location, an additional bagger is also required. This can be avoided if the second cuber can be stacked on top of the first cuber, but usually there is not enough space above the first cuber for a second.

It is an object of this invention to provide a method of and apparatus for making ice cubes, bagging the ice cubes, and storing the ice cubes that includes a bagger that can bag the output of two side-by-side cubers.

It is a further object of this invention to provide a method of bagging ice cubes from two side-by-side cubers comprising the steps of dumping the ice cubes from each cuber into hoppers located below each cuber and moving the ice cubes from the hoppers to the bagger.

It is a further object and feature of this invention to provide a method of bagging ice cubes from two side-by-side cubers using one bagger comprising the steps of freezing a preselected volume of water in each cuber to produce a batch of cubes from each cuber having a preselected weight, discharging each batch of cubes into a hopper below the cuber, alternately moving each batch of ice cubes from the hoppers to a bagger, and bagging each batch of cubes in a separate bag.

It is a further object and feature of this invention to provide apparatus for bagging ice cubes produced by two side-by-side cubers using one bagger and for moving the filled bag into a storage bin comprising a hopper positioned under each cuber to receive periodically a batch of ice, the hoppers weighing a predetermined amount, an ice receiving chute in the bagger, means for moving the ice from first one of the hoppers then the other to the ice receiving chute, means for moving a bag under the chute with its upper end open to receive each batch of ice as it is moved into the ice receiving chute from the hoppers, means for sealing each ice filled bag, and means for moving each ice filled bag into a storage bin.

Ray's design has other problems, for example, the bags, after being filled with ice and sealed, drop directly into the storage bin or storage compartment and stack up under the inlet to the storage bin. As a result, Ray's ice bagger cannot run unattended for any length of time because someone has to periodically move the bags from under the inlet so that additional bags can enter. Further, with Ray's arrangement, the platen that carries the stack of empty bags moves into position to have the outside bag filled with ice, then has to be moved out of the way to allow the sealer to come in and seal the bag. As a result, the hooks that extend through the holes on the long side of the bag and support the bag are ripped out as the bag carrying platen moves back to its original position leaving the bag unsupported at the upper end before the bag is sealed. This can create some problems and result in some of the bags having a poor seal or no seal. Further, the platen that holds the bags is always in one of two positions, either upright or at an angle of about 60° from the horizontal. This makes it difficult to reload the platen with additional bags. Another problem with the Ray machine is that the bag that is being filled is totally supported by the trap door that closes the inlet to the storage bin. Once the bag carrying platen is moved out of the way before the bag is sealed, the bag can slump due to the weight of the ice and there is nothing to hold the upper end of the bag in proper position for sealing.

Therefore, it is a further object of this invention to provide such apparatus that supports the upper end of the long side of the bag after it is filled with ice until the bag has been sealed.

It is an additional object and feature of this invention to provide such apparatus in which the ice-filled bag is supported at the bottom by a solid platform and on the sides by a sleeve through which the bag extends while the bag is being filled and sealed prior to being moved into the storage bin.

It is another object and feature of this invention to provide a method and apparatus for tilting the bags from the vertical before they move through the inlet into the storage bin to cause the bags to fall sideways into the storage bin and consequently roll away from the inlet.

It is yet another object and feature of this invention to support a plurality of bags that have a short side and a long side with the long side having holes to receive a first pair of parallel rods to support the bags and in which a platen is moved into engagement with the short side of the bag and the pressure is dropped between the platen and the bag to cause the bag to move with the platen as the platen moves back into position to receive ice from the refrigerating unit, while at the same time, moving the holes on the long side of the bag from the first pair of rods to a second pair of support rods so that the bag will be supported during the filling operation. With this arrangement, the rack or platen holding the supply of bags can be rotated to a horizontal position outside of the cabinet in which the apparatus is located to allow additional bags to be easily placed on the supporting rods when an additional supply of bags is required.

These and other objects, advantages, and features of this invention will be apparent to those skilled in the art from a consideration of this specification, including the attached drawings and appended claims.

IN THE DRAWINGS

Figure 1:
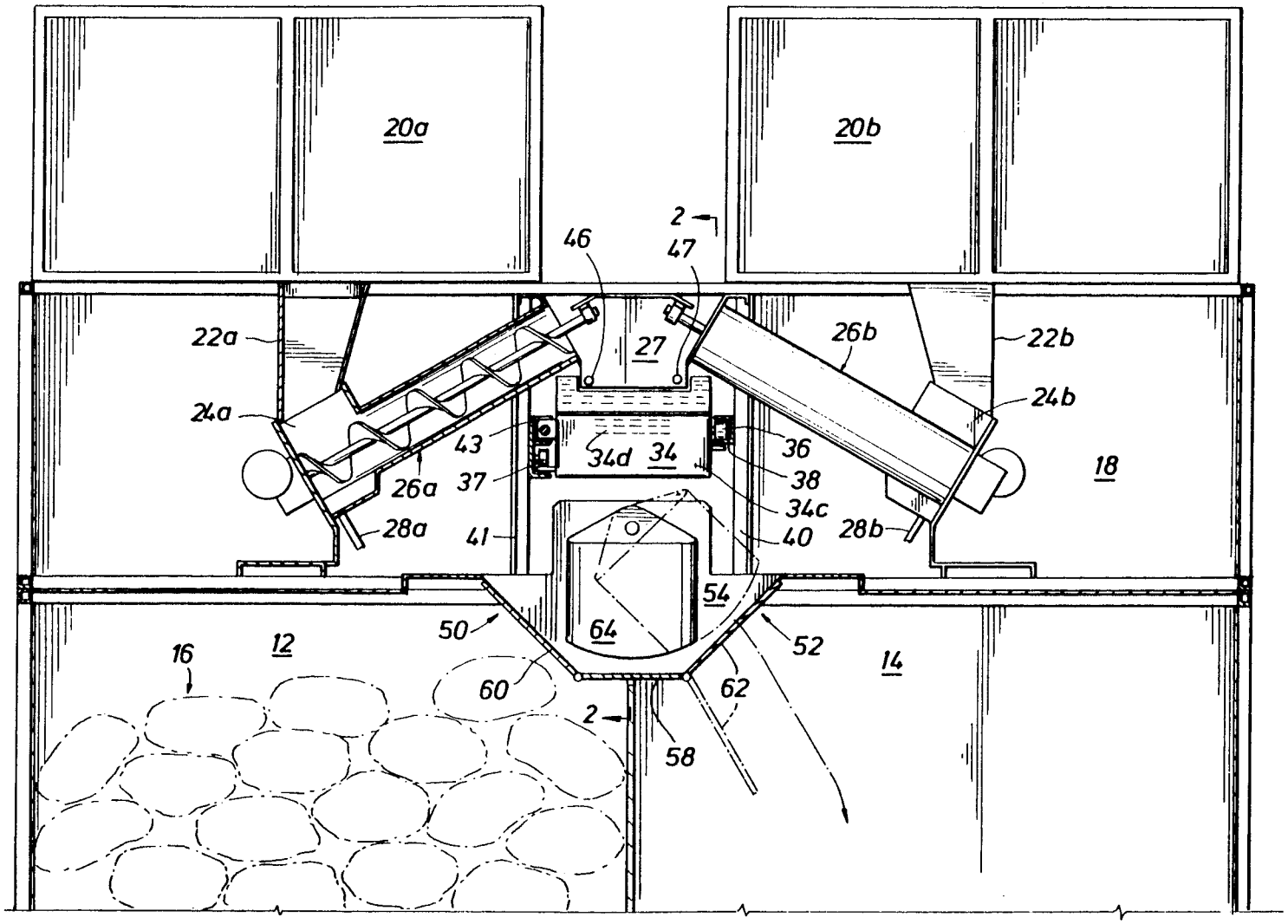
FIG. 1 is a front view of the apparatus partly in section and partly in elevation, showing general arrangement of the apparatus using two cubers with one bagger, the internal arrangement of the bagging apparatus, and the apparatus for delivering the bags into the storage bin sideways.

In the embodiment shown, the apparatus is enclosed by a cabinet indicated by the number 10. Two storage bins 12 and 14 are located in the lower part of the cabinet. Storage bin 12 is shown partly filled with bags of ice, indicated by the number 16. Located in the upper section 18 of the cabinet above the storage bins is the ice handling, bag filling, bag sealing, and bag handling equipment. Two refrigeration unit cubers, 20 and 22 that convert the water to ice cubes are located on top of the cabinet in generally side-by-side arrangement.

In the embodiment shown, the equipment is set up to handle two refrigeration units or cubers with one bagger but it could operate with only one ice-making unit, if that supplied sufficient ice for the demand. On the other hand, the one bagger could handle the output of from three to six or more cubers if there is room to stack them on the two cubers shown.

The ice-handling apparatus shown in section 18 of the cabinet includes chutes 22*a* and 22*b* through which the ice cubes manufactured by cubers 20*a* and 20*b* are discharged into hoppers 24*a* and 24*b*. The term "ice cubes" as used throughout the specification means frozen particles of ice regardless of their shape. Screw conveyors 26*a* and 26*b* are positioned to move ice cubes upwardly from each hopper into ice dispensing chute 27. The hoppers have drains 28*a* and 28*b* to keep water from accumulating in the hoppers and be carried up to the ice dispensing chute with the ice.

Figure 2:
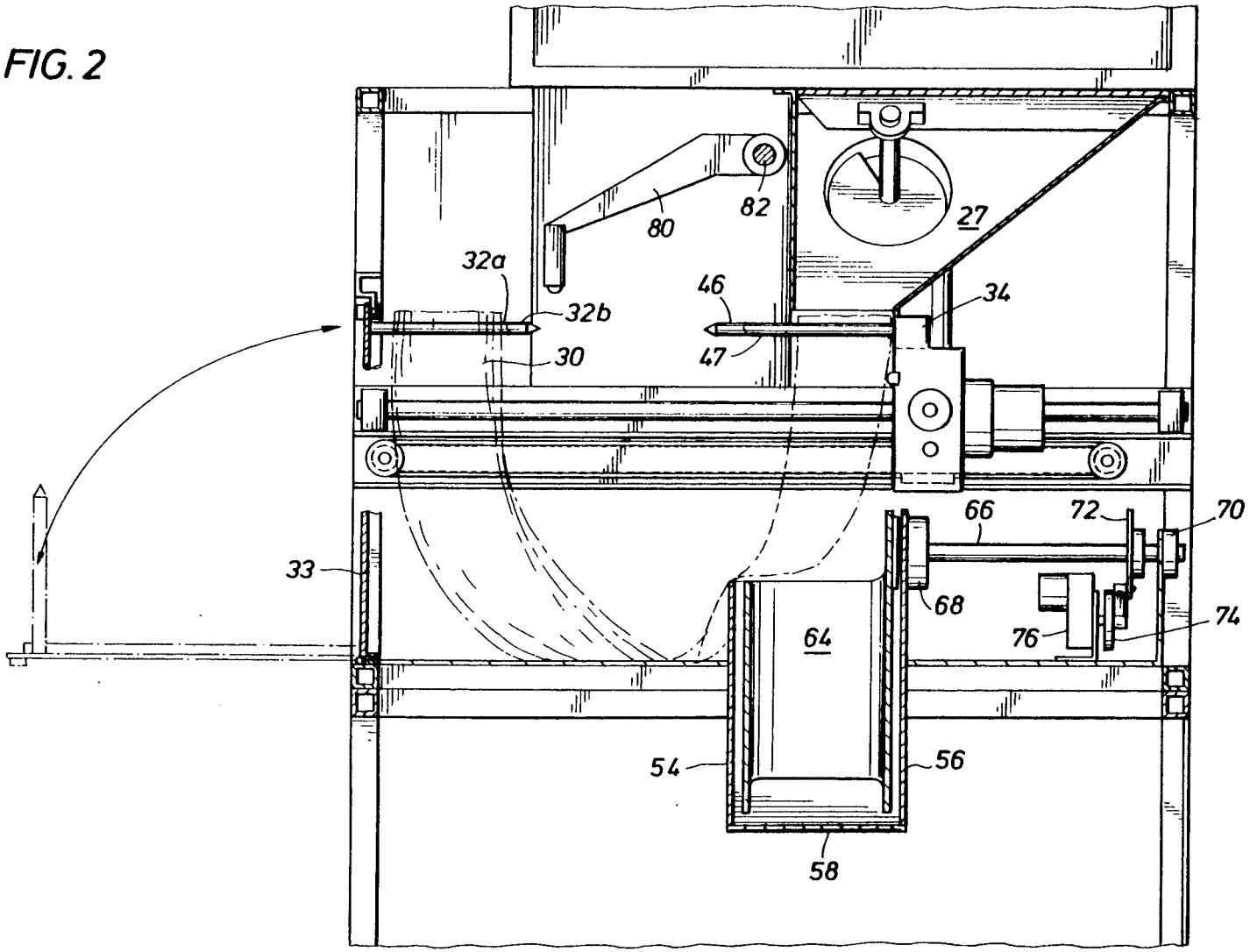
FIG. 2 is a view, partly in section and partly in elevation, taken along line 2—2 of FIG. 1 showing the position of the components of the apparatus after one bag has been removed from the supply bags and is moved into position to receive ice from the ice making apparatus.
Figure 3:
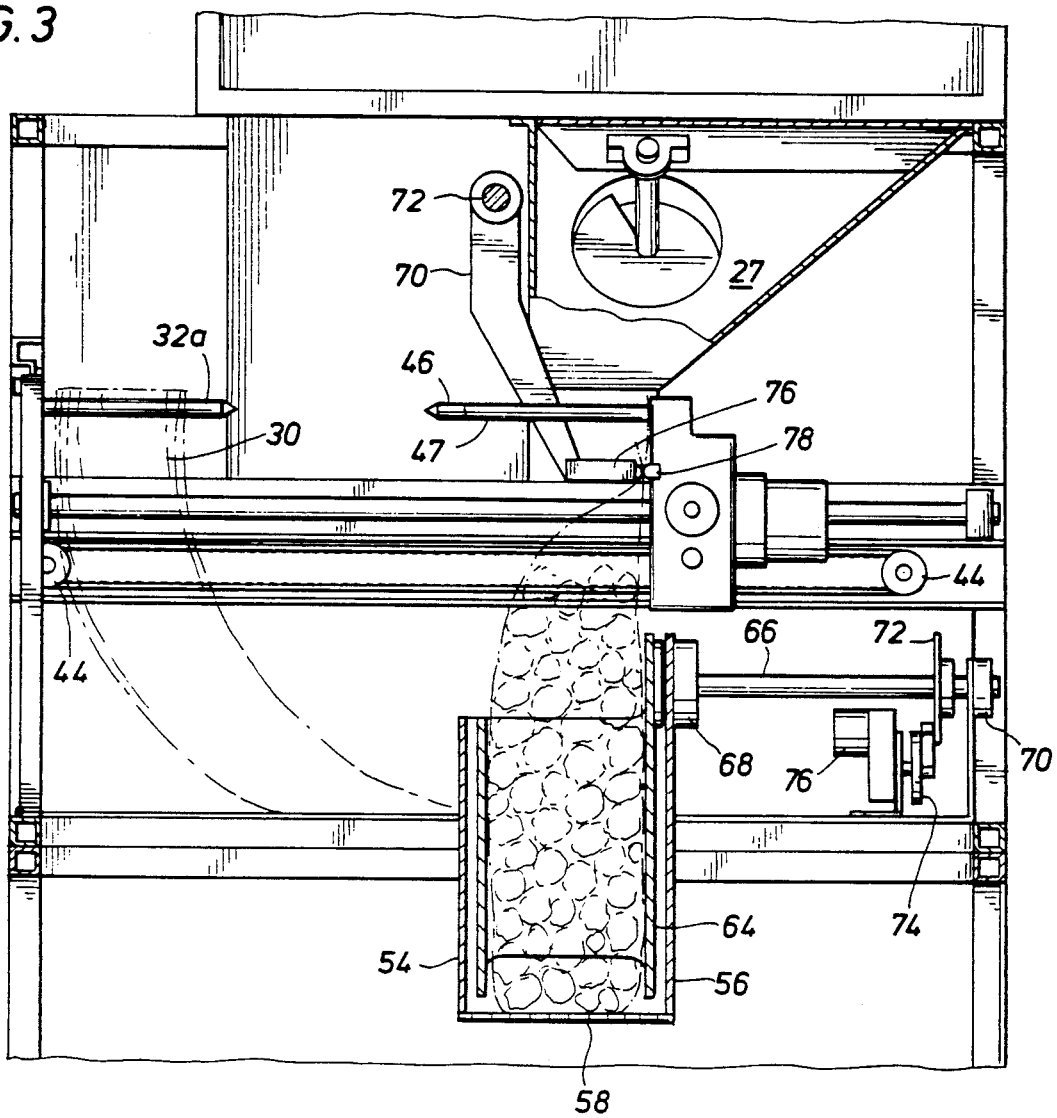
FIG. 3 is a view of the same apparatus as shown in FIG. 2 at the point in time that the bag is being sealed after being filled with ice.
Figure 5:
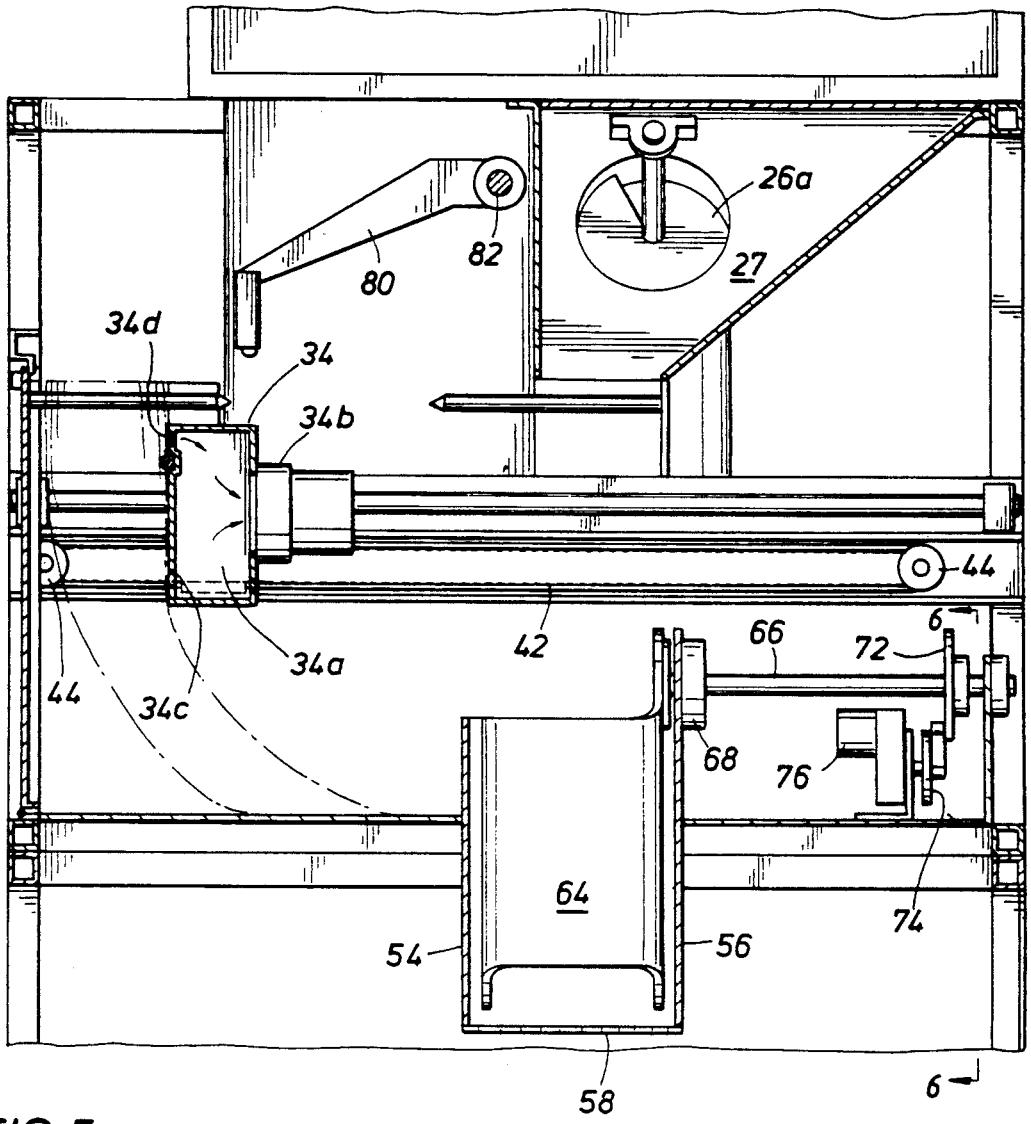
FIG. 5 is a view similar to FIGS. 2 and 3 showing the platen in engagement with the outside bag on the stack of bags supported by the first set of parallel horizontal rods with the pressure between the platen and the short side of the bag being reduced so that the platen can pull the bag to the position shown in FIG. 2 when it returns to its position adjacent the outlet of the ice discharge chute.
Figure 6:
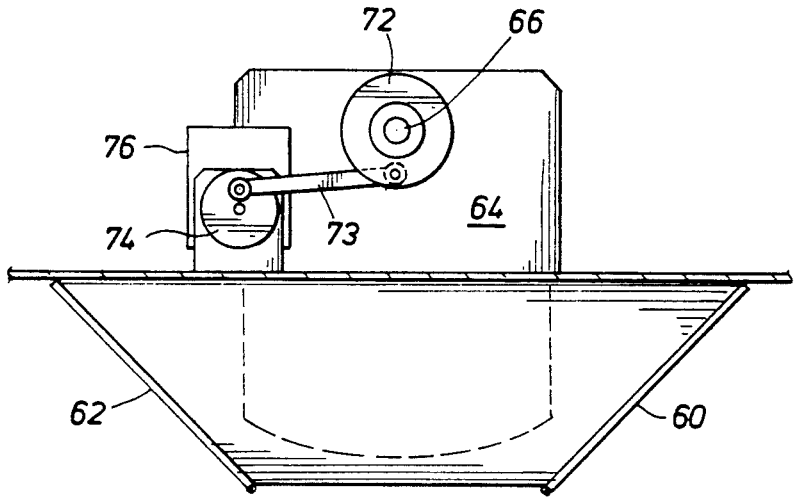
FIG. 6 is a view taken along line 6—6 of FIG. 5 showing the mechanism for causing the sleeve to tilt the bags from the vertical as they are being moved into the storage bins.

The bags are moved one at a time into position to receive the ice by the apparatus shown in FIGS. 2, 3, and 5. As shown in FIGS. 2 and 3, a plurality of bags 30 are supported by a first pair of parallel rods 32*a* and 32*b* supported by door 33. The door can be pivoted to the position shown thereby allowing an additional supply of bags to be supplied to the apparatus. These rods extend through holes in one side of the bags that are longer than the other side. The short side of the bag will stop somewhere below the parallel rods. Platen 34 is supported by two pairs of rollers 36 and 37, only one of which is shown, mounted on opposite sides of the platen that engage U-shaped tracks 38 and 39 mounted on posts 40 and 41. The platen is moved back and forth between the position shown in FIG. 5 and that of FIGS. 2 and 3 by belt 42 both ends of which are connected to opposite sides of plate 43 attached to the side of the platen. Preferably, a belt such as a timing belt is used so that the movement of the platen is very carefully controlled. The belt is moved by a servo motor (not shown) rotating one of sheaves 44.

Platen 34 includes chamber 34*a* that is connected to vacuum pump 34*b*. Front plate 34*c* of the platen has a plurality of narrow slits 34*d* that will cause the short side of a bag to be held against the front plate 34*c* when the pressure in chamber 34*a* is reduced below atmospheric pressure. Therefore, in operation, platen 34 is moved to the position shown in FIG. 5, the pressure in the chamber is reduced and atmospheric pressure will hold the short side of the bag against the platen so that when it returns to the position shown in FIG. 2, it will carry the outside bag of the stack of bags with it. The long side of the bag will move off of the first set of parallel rods and then move over the second set of parallel rods 46 and 47. This movement will open the bag and position the bag below the ice dispensing chute.

As shown in FIGS. 1 and 2, bins 12 and 14 are provided with inlets 50 and 52. The inlets are bound on the side by vertical plates 54 and 56, as shown in FIG. 2 and on the bottom by horizontal support plate 58. The inlets are closed by doors 60 and 62 that are attached on opposite sides of support plate 58 to pivot between the position shown in FIG. 1, closing the inlets, to the position of door 62 shown by dashed lines. Springs maintain the doors closed at all times except when a bag is being delivered to the bin. This keeps the cold and often humid air in the bins out of the bagging area. This helps prevent the formation of slime and rust on the equipment.

Positioned above support plate 58 and in between vertical walls 54 and 56 is sleeve 64. The sleeve is supported by shaft 66 that extends through wall 56 and appropriate bearings located in bearing housing 68 mounted on wall 56 and bearing housing 70 mounted on support bracket 71. Plate 72 mounted on shaft 66 is connected by link 73 to plate 74 that is rotated by electric motor 76. Motor 76 is designed to rotate shaft 66 and cause sleeve 64 to move to the dotted line position shown in FIG. 1 when discharging a bag of ice into bin 14. When the next bag of ice that is discharged, motor 76 will pivot sleeve 64 in the opposite direction and discharge the bag into bin 12. When one bin is full, as shown in FIG. 1, a signal will be sent to the control mechanism so that sleeve 64 discharges ice only into bin 14.

As shown in FIG. 2, since the bag is long enough to extend from support surface 58 to support rods 46 and 47, it will drape over the edge of wall 54 and the upper end of sleeve 64 when first moved into position to receive ice. But when ice enters the bag from ice dispensing chute 27, the weight of the ice will pull the bag into sleeve 64 and cause the bottom of the bag to rest on support surface 58 as the bag is filled as shown in FIG. 3.

Figure 4:
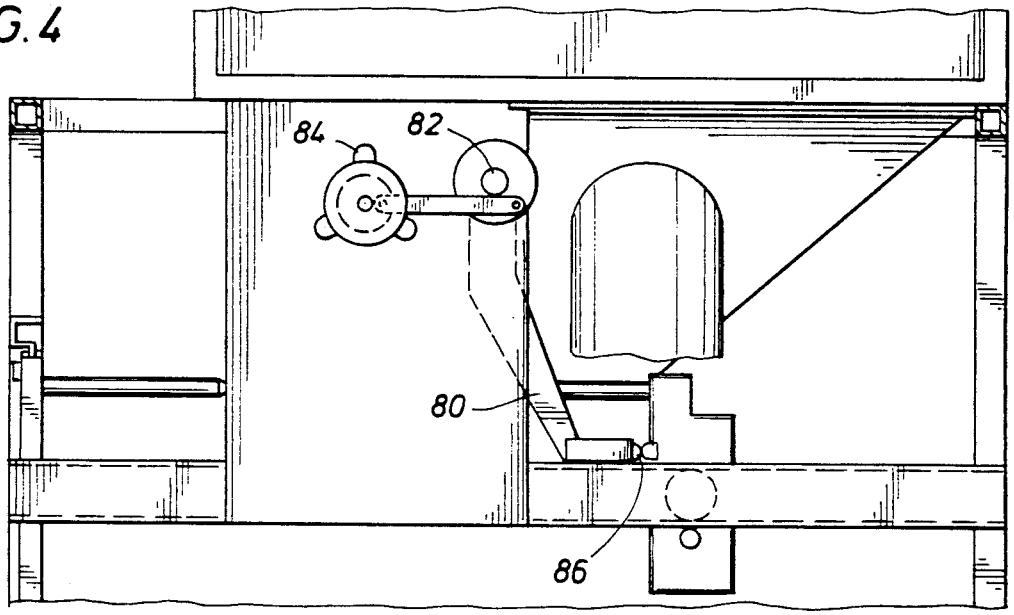
FIG. 4 shows the mechanism for moving the heat sealer into and out of sealing engagement with the bags.

After the bag is filled, while still being supported on parallel rods 46 and 47 and the short side is being held against the platen by the vacuum, crank arm 80 that is mounted on shaft 82 is rotated by motor 84 and the mechanism shown in FIG. 4 to move heating element 86 into engagement with the same circular edge of rod 78 mounted in the platen. Heat is then applied to the bag to fuse the long and short side, seal the bag and cut the bag loose from the supporting pins. Crank arm 70 is then rotated back to the position shown in FIG. 2.

At this time, motor 76 will rotate shaft 66 and pivot the sleeve 64 to the right or the left as the case may be. As shown in FIG. 1, the sleeve has been rotated to the right. When this occurs, the bag of ice in the sleeve will be moved off support surface 58 and its weight will open door 62 and, if the bag was not cut loose by the heating element, also tear the long side of the bag from the second pair of support rods so that the bag can fall into bin 14. The door will pivot downwardly and will extend downwardly and outwardly so that as the bag slides into the bin, it will tend to fall sideways so that the bags entering the bin will tend to stack up on their sides rather than stack up on their ends. As a result, the bags will tend to roll away from the inlet as bags accumulate below the inlet and fill up the bin.

Thus in operation, ice cubes are formed by refrigeration units 20*a* and 20*b* and dumped into a hopper. Where two refrigeration units are used, they are timed so they won't dump ice at the same time. A bag having a short side and a long side is moved by a platen that reduces the ambient atmospheric pressure between the platen and the short side of the bag into position under an ice dispensing chute. The ice cubes from the hopper are dumped in the bag that is supported on a support surface, by a sleeve, and by two parallel support rods. The bag is then sealed and the sleeve rotated to move the bag off the support so it will tear the long side from the support rods, open the spring loaded door to the storage bin and fall sideways into the bin.

From the foregoing it will be seen that this invention is one well adapted to attain all of the ends and objects hereinabove set forth, together with other advantages which are obvious and which are inherent to the apparatus and method.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A method of sequentially filling bags with ice cubes and depositing the ice filled bags into a storage bin having two inlets for the bags on opposite sides of a bag supporting surface on top of the bin, said bags having a short side and a long side with the long side having holes to allow the bags to be supported by horizontal parallel rods extending through the holes, the method comprising the steps of sequentially freezing a batch of water into ice cubes, discharging each batch of ice cubes into a hopper through a downwardly extending chute, moving a platen against a supply of bags the short side of the outside bag of a supply of bags hanging from a first set of parallel rods extending through the holes in the long sides of the bags, reducing the air pressure between the platen and the short sides of the bags to cause ambient atmospheric pressure to hold the short side of the outside bag against the platen, moving the platen laterally to move the short side of the bag away from the long side of the bag to open the bag as the bag is positioned under an ice dispensing chute and to move the holes in the long side over a second pair of parallel support rods, supporting the bottom of the bag on the bag supporting surface on the top of the storage bin, moving the ice cubes from the hopper and into the bag through the ice dispensing chute, sealing the bag, and alternately tilting the bags in opposite directions from the vertical to cause the bags to fall into one storage bin then the other.

2. The method of claim 1 further including the steps of using the weight of the ice to open each inlet to let the bag fall through and closing the inlet after the bag has fallen through to keep to a minimum the amount of air in the storage bin that escapes from the bin through the open inlets.

3. A method of bagging ice cubes from two side-by-side cubers using one bagger comprising the steps of freezing a preselected volume of water in each cuber to produce a batch of cubes from each cuber having a preselected weight, discharging each batch of cubes into a hopper below the cuber, alternately moving each batch of ice cubes from the hoppers to a bagger, and bagging each batch of cubes in a separate bag.

4. The method of claim 3 in which the bags have a short side and a long side with the long side having holes to allow the bags to be supported by horizontal parallel rods extending through the holes, the method further comprising the steps of freezing a batch of water into ice cubes, discharging the ice cubes into a hopper, moving a platen against the short side of a bag hanging from a first set of parallel rods extending through the holes in the long side of the bag, reducing the air pressure between the platen and the short side of the bag to cause ambient atmospheric pressure to hold the short side of the bag against the platen, moving the platen laterally to move the short side of the bag away from the long side to open the bag as the bag is positioned to receive the ice cubes and to move the holes in the long side over a second pair of parallel support rods, supporting the bottom of the bag, moving the ice cubes from a hopper into the bag, and sealing the bag.

5. The method of claim 3 further including the step of alternately moving each bag of cubes laterally to cause every other bag to fall into storage along a different path from the first bag.

6. The method of claim 5 or 4 in which the path into storage is inclined from the vertical.

7. The method of claim 5 or 4 further including the step of tilting the filled bag at an angle to the vertical sufficient to cause the bag to fall sideways into the storage bin as the bag is moved laterally.

8. Apparatus for automatically making, bagging, and storing ice cubes comprising means for freezing water into ice cubes having a predetermined weight, and depositing the ice cubes into a hopper, a plurality of bags having a long side and a short side with the long side having a pair of spaced holes, a first pair of horizontal rods for extending through the holes in the long side of the bags to support the bags in a generally upright position, a second pair of parallel, horizontal, support rods, a platen movable between a bag engaging position and a bag filling position; means for reducing the atmospheric pressure between the platen and the short side of the bag when the platen is in engagement with the bag to cause the short side of the outside bag to be held against the platen by atmospheric pressure as the platen moves to its bag filling position to move the short side of the bag away from the long side and open the bag, a second pair of parallel, horizontal rods to engage the holes in the long side when the platen moves to its bag filling position to support the bag, means for moving the ice cubes from the hopper into the open bag, a storage bin for supporting the bottom of the bag as it is being filled with the ice cubes, said storage bin having first and second inlets for the bags on opposite sides of the top of the storage bin, means for sealing the bag, and means for tilting the bags in first one direction then the other to cause the bag to alternate falling through the first and second inlets.

9. The apparatus of claim 8 in which each inlet is provided with a door, means mounting each door to pivot between an open and closed position, and resilient means for holding the door in the closed position.

10. The apparatus of claim 9 in which each door when in the closed position is inclined upwardly and outwardly from the support surface and is pivotally connected to the support surface so that when the door is forced open by the weight of the ice filled bag, the door will pivot to a position extending downwardly and outwardly from the support surface to cause the bags to fall into the bin at an angle to the vertical and stack up in a horizontal position in the storage bin.

11. The apparatus of claim 8 in which the means for tilting the bags of ice comprises a sleeve into which the bag is pulled as the bag is filled with ice and means for rotating the sleeve around a horizontal axis to move the bag laterally of the bag supporting means and allow the bag to fall through the sleeve and sideways into the storage bin.

12. The apparatus of claim 8 further provided with means for stopping the alternate tilting of the bags should one bin fill before the other while allowing the filled bag to continue to be tilted toward the unfilled bin.

13. A method of sequentially filling bags with ice cubes and depositing the ice filled bags into a storage bin having an inlet for the bags that is inclined to the vertical, said bags having a short side and a long side with the long side having holes to allow the bags to be supported by horizontal parallel rods extending through the holes, the method comprising the steps of sequentially freezing a batch of water into ice cubes, discharging each batch of ice cubes into a hopper through a downwardly extending chute, moving a platen against a supply of bags the short side of the outside bag of a supply of bags hanging from a first set of parallel rods extending through the holes in the long sides of the bags, reducing the air pressure between the platen and the short sides of the bags to cause ambient atmospheric pressure to hold the short side of the outside bag against the platen, moving the platen laterally to move the short side of the bag away from the long side of the bag to open the bag as the bag is positioned under an ice dispensing chute and to move the holes in the long side over a second pair of parallel support rods, supporting the bottom of the bag on the top of the storage bin, moving the ice cubes from the hopper and into the bag through the ice dispensing chute, sealing the bag, and moving the bag laterally from the top of the storage bin into the inlet to allow the weight of the ice in the bag to tear the long side of the bag away from the second pair of support rods freeing the bag to fall into the storage bin.

14. The method of claim 13 further including the step of tilting the filled bag at an angle to the vertical sufficient to cause the bag to fall sideways into the storage bin as the support is removed from the bottom of the bag.

15. The method of claim 13 in which the storage bin has two inlets, one on each side of the bag supporting surface on top of the bin and further including the step of alternately tilting the bags in opposite directions from the vertical to cause the bags to fall into one storage bin then the other.

16. The method of claim 15 further including the steps of using the weight of the ice to open each inlet to let the bag fall through and closing the inlet after the bag has fallen through to keep to a minimum the amount of air in the storage bin that escapes from the bin through the open inlets.

17. Apparatus for bagging ice cubes produced by two side-by-side cubers using one bagger and for moving the filled bag into a storage bin comprising, a hopper positioned under each cuber to receive periodically a batch of ice weighing a predetermined amount, an ice receiving chute in the bagger, means for moving the ice from first one of the hoppers then the other to the receiving chute, means for moving a bag under the chute with its upper end open to receive each batch of ice as it is moved into the ice receiving chute from the hoppers, means for sealing each ice filled bag, and means for moving each ice filled bag into a storage bin.

18. The apparatus of claim 17 in which the bottom of the bag being filled with ice cubes is in engagement with and supported by the top of the storage bin until moved laterally by the sleeve.

19. The apparatus of claim 17 further provided with means to support the sides of the bags as they are filled.

20. The apparatus of claim 17 in which the means for moving the ice filled bags to storage include a sleeve in which the bags are positioned while being filled with ice cubes, inlets to the storage bin located to each side of the ice filled bag, and means for rotating the sleeve around a horizontal axis to rotate each ice filled bag around the horizontal axis to a position where the bag will fall from the sleeve into the storage bin through one of the inlets.

21. The apparatus of claim 17 in which the inlets are provided with doors, resilient means for maintaining the doors in position closing the inlets until the weight of an ice filled bag forces the doors open as the bag passes through the inlet.

22. In an automatic ice cube making, bagging, and storing apparatus, the subcombination comprising a storage compartment having an inlet through which bags of ice can be dropped into the compartment, said compartment having a flat upper wall adjacent the inlet for supporting a bag as it is being filled with ice cubes, a door movable between a position closing the inlet to a position extending downwardly into the storage bin at an angle to cause the bags of ice passing through the inlet to tend to stack in the storage compartment on their sides.

23. The subcombination of claim 22 further including a second storage compartment having an inlet on the opposite side of the bag supporting upper wall from the first mentioned inlet, a door movable between a position closing the inlet of the second storage compartment and a position extending downwardly into the storage bin at an angle to cause the bags of ice passing through the inlet to tend to stack in the second storage compartment on their sides.

24. The subcombination of claim 23 further provided with a sleeve, means for supporting the sleeve above the bag supporting upper wall with its longitudinal axis vertical to allow the sleeve to laterally support a bag being filled with ice and means rotating the sleeve around a horizontal axis to move the ice-filled bag into position to fall through an inlet in one of the storage compartments.

25. The subcombination of claim 24 in which the sleeve rotating means rotates the sleeve first in one direction and then another to deposit ice-filled bags alternately in the storage compartments.

* * * * *